US009875586B2

(12) United States Patent
Reitsma

(10) Patent No.: US 9,875,586 B2
(45) Date of Patent: Jan. 23, 2018

(54) INDUCTIVE CODED LOCK SYSTEM

(71) Applicant: TEXAS INSTRUMENTS INCORPORATED, Dallas, TX (US)

(72) Inventor: George Pieter Reitsma, Redwood City, CA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/003,790

(22) Filed: Jan. 21, 2016

(65) Prior Publication Data

US 2016/0210798 A1 Jul. 21, 2016

Related U.S. Application Data

(60) Provisional application No. 62/106,143, filed on Jan. 21, 2015.

(51) Int. Cl.
*G07C 9/00* (2006.01)
*E05B 47/00* (2006.01)

(52) U.S. Cl.
CPC ..... *G07C 9/00007* (2013.01); *E05B 47/00* (2013.01); *E05B 47/0045* (2013.01); *G07C 9/00706* (2013.01); *G07C 9/00714* (2013.01); *G07C 2009/00611* (2013.01); *G07C 2009/00777* (2013.01)

(58) Field of Classification Search
CPC ..... G07C 9/00722; G07C 9/00103; G07C 9/00309; G07C 2009/00777; G07C 9/00023; G07C 9/00182; G07C 9/00571; G07C 2009/00611
USPC ..... 340/5.66
See application file for complete search history.

(56) References Cited

U.S. PATENT DOCUMENTS 6,318,137 B1 * 11/2001 Chaum ..... E05B 49/002 340/5.67
7,712,341 B2 * 5/2010 Johansson ..... E05B 47/063 70/277
8,851,530 B2 * 10/2014 Geringer ..... E05B 47/0012 292/144

* cited by examiner

*Primary Examiner* — Mark Blouin
(74) *Attorney, Agent, or Firm* — Andrew Viger; Charles A. Brill; Frank D. Cimino

(57) ABSTRACT

An inductive coded lock system includes an inductive lock mechanism, and a conductive key/target. The inductive lock mechanism includes multiple inductor coils and sensor circuitry. Each inductor coil is operable to project a magnetic field defining a sensing area proximate to the inductor/coil, the inductor coils being spatially arranged to define a key/target sensing area incorporating each inductor coil sensing area. The sensor circuitry drives inductor coils, and measures sensor response (such as with an inductance comparator) to a key/target inserted within the key/target sensing area, including detecting an unlock condition corresponding to a pre-defined coded lock pattern. The key/target includes active and inactive areas (such as conductive/nonconductive) corresponding spatially to the sensing areas in the key target sensing area, the active and inactive areas arranged in a pre-defined coded key pattern corresponding to the pre-defined coded lock pattern. The coded lock and key patterns can be binary coded.

18 Claims, 4 Drawing Sheets

INDUCTIVE CODED LOCK SYSTEM

CROSS-REFERENCE TO RELATED APPLICATIONS

Priority is claimed under 37 CFR 1.78 and 35 USC 119(e) to U.S. Provisional Application 62/106,143, filed 21 Jan. 2015, which is incorporated by reference.

BACKGROUND

Technical Field

This Patent Disclosure relates generally to inductive proximity sensors/switches.

Related Art

An inductive sensor includes an inductive coil sensor and sensor electronics. The sensor electronics drives the sensor coil, projecting a sensing B-Field, and then measures/acquires a sensor response, such as a change in sensor coil inductance in response to a conductive target.

As illustrated in FIG. 1, for proximity sensing, an inductive proximity sensor/switch, represented by a sensor coil (11) is designed to switch when a conductive target (15) is proximate to the sensor coil (within the sensor coil's sensing range). An inductive sensor (coil and electronics) can be configured for sensitivity to a conductive target that is present immediately proximate to the coil, within a sensing area (12).

BRIEF SUMMARY

This Brief Summary is provided as a general introduction to the Disclosure provided by the Detailed Description and Drawings, summarizing aspects and features of the Disclosure. It is not a complete overview of the Disclosure, and should not be interpreted as identifying key elements or features of, or otherwise characterizing or delimiting the scope of, the disclosed invention.

According to aspects of the Disclosure, an inductive coded lock system includes an inductive lock apparatus, and an inductive key/target element. The lock apparatus includes multiple inductor coils spatially arranged in a non-overlapping sequence to define a key-insertion sensing area incorporating the key/target sensing areas for each coil. The key/target is dimensioned for insertion into the key-insertion sensing area, and includes active and inactive key/target sections (such as conductive/nonconductive) arranged in a pre-defined coded (such as binary) key-unlock sequence. When the key/target is inserted into the key-insertion sensing area, each key/target section is aligned within a respective key/target sensing area. The lock apparatus includes sensor circuitry to drive each of the inductor coils to project the magnetic sensing field for the associated key/target sensing area, and to measure (such as with a differential inductance comparator) sensor response to a key/target inserted within the key-insertion sensing area, including detecting an unlock condition corresponding to the pre-defined coded key-unlock sequence.

According to other aspects of the Disclosure, an inductive lock apparatus is suitable for use with a key/target element including active and inactive key/target sections (such as conductive/ nonconductive) arranged in a pre-defined coded key-unlock sequence (such as binary coded). The inductive lock apparatus includes multiple inductor coils each operable to project a magnetic field to define a key/target sensing area proximate to the inductor coil. The inductor coils are spatially arranged in a non-overlapping sequence to define a key-insertion sensing area encompassing each key/target sensing area. The inductive lock apparatus is adapted for insertion of the key/target element within the key-insertion sensing area, such that each key/target section aligns with a respective key/target sensing area. The inductive lock apparatus includes sensor circuitry to drive each of the inductor coils to project a magnetic sensing field into the associated key/target sensing area, and to measure (such as with a differential inductance comparator) sensor response to a key/target element inserted within the key-insertion sensing area, including detecting an unlock condition corresponding to the pre-defined coded key-unlock sequence of active and inactive target sections.

According to other aspects of the Disclosure, key/target element suitable for use in an inductive coded lock system with an inductive lock apparatus. The inductive lock apparatus can include multiple inductor coils coupled to sensor circuitry: (a) each inductor coil is operable to project a magnetic field to define a key/target sensing area proximate to the inductor coil, the inductor coils spatially arranged in a non-overlapping sequence to define a key-insertion sensing area encompassing each key/target sensing area; and (b) the sensor circuitry to drive each of the inductor coils to project a magnetic sensing field into the associated key/target sensing area, and to measure (such as with a differential inductance comparator) sensor response to a key/target element inserted within the key-insertion sensing area. The key/target element can include active and inactive key/target sections (such as conductive nonconductive) arranged in a pre-defined coded key-unlock sequence (such as binary coded), and can be adapted for insertion within the key-insertion sensing area of the inductive lock apparatus such that: (a) each key/target section aligns with a respective key/target sensing area, and (b) when the key/target element is inserted into the key-insertion sensing area of the inductive lock apparatus, the pre-defined coded key-unlock sequence is detectable by the inductive lock apparatus as a an unlock condition.

Other aspects and features of the invention claimed in this Patent Document will be apparent to those skilled in the art from the following Disclosure.

BRIEF DESCRIPTION OF THE DRAWINGS

FIG. 4A illustrates an example with two rows of inductor coils, requiring correspondingly configured key/target (415) and sensor lock/target (414)

DETAILED DESCRIPTION

This Description and the Drawings constitute a Disclosure for ground fault detection based on capacitive sensing, including example embodiments that illustrate various technical features and advantages.

In brief overview, An inductive coded lock system includes an inductive lock apparatus, and an inductive key/target element. The lock apparatus includes multiple inductor coils spatially arranged in a non-overlapping sequence to define a key-insertion sensing area incorporating the key-target sensing areas for each coil. The key-target is dimensioned for insertion into the key-insertion sensing area, and includes active and inactive key/target sections (such as conductive/nonconductive) arranged in a pre-defined coded (such as binary) key-unlock sequence. When the key/target is inserted into the key-insertion sensing area, each key/target section is aligned within a respective key/target sensing area. The lock apparatus includes sensor circuitry to drive each of the inductor coils to project a magnetic field into the associated key/target sensing area, and to measure (such as with a differential inductance comparator) sensor response to key/target insertion within the key/insertion sensing area, including detecting an unlock condition corresponding to the pre-defined coded key-unlock sequence.

Lock apparatus is used in this Disclosure as a general, non-limiting term for an apparatus that provides a point of secure entry or access requiring an associated physical key or unlocking device.

Figure 1:
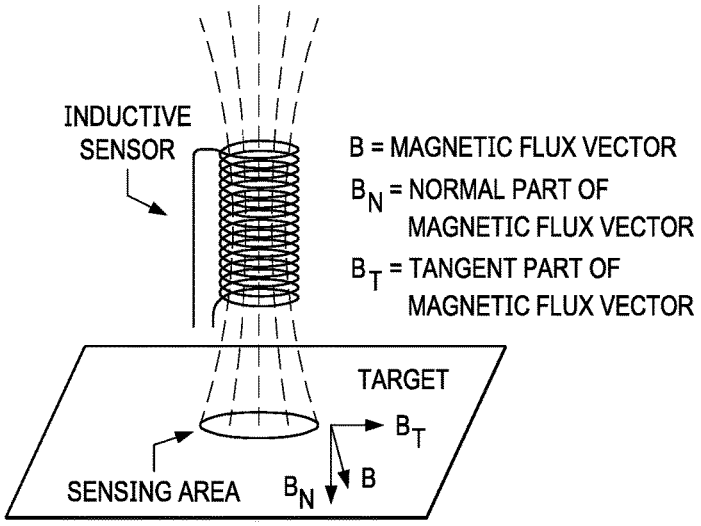
FIG. 1 illustrates an inductive sensor coil (11) operable to generate a sensing field defining a sensing area (12), such as for sensing a proximate target (15) within the sensing area.
Figure 2:
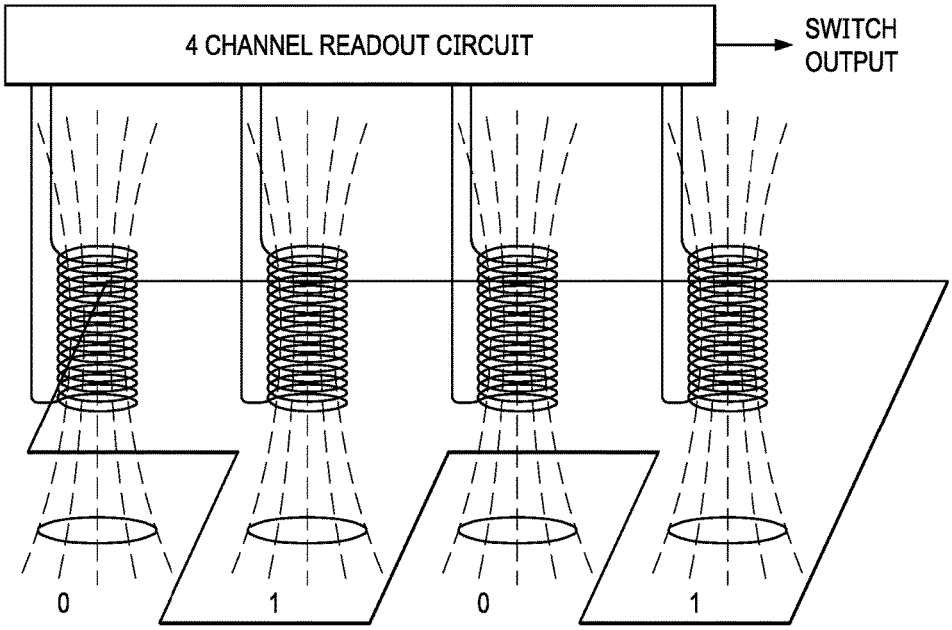
FIG. 2 illustrates an example of an inductive binary coded lock/security system (200), including an inductive lock apparatus (210) configured for operation with a binary coded conductive key/target (215), the lock apparatus (210) including multiple inductor coils (211) coupled to sensor electronics (213).

FIG. 2 illustrates an example functional embodiment of an inductive binary coded security system 200, including an inductive lock apparatus 210 configured for operation with a binary coded conductive key/target 215. Lock mechanism 210 includes multiple inductor coils 211 coupled to sensor electronics 213.

Inductor coils 211 are spatially arranged to define a key/target sensing area 212A into which key/target 215 can be introduced/inserted, proximate to the inductor coils. As illustrated, inductor coils 211 each define an associated sensing areas 212 within key/target sensing area 212A212.

Key/target 215 is constructed of metallic or other conductive or magnetic material (the terms conductive/nonconductive and metallic/nonmetallic are used interchangeably in this Disclosure). Since an inductive coil does not respond to any target that is both non-magnetic and non-conductive, the key/target can be encapsulated in a non-magnetic/non-conductive enclosure, for example, plastic.

According to this Disclosure, inductive lock apparatus 210 is configured for use with a conductive key/target 215 constructed with a pre-defined coded pattern of metallic and non-metallic areas designated 215A and 215B. According to aspects of this Disclosure, inductive lock mechanism 210 and key/target 215 are configured for a pre-defined binary coded lock/key pattern, in which lock apparatus 210 embodies a binary coded lock pattern, and key/target 215 embodies a corresponding binary coded key pattern.

That is, inductive lock apparatus 210 (sensor electronics 213) is configured (programmed) to respond only to a proximate key/target (within key/target sensing area 212A) with the pre-defined binary coded sequence or key pattern of metallic/nonmetallic areas: 1 metal, 0=nonmetallic. In effect, lock apparatus 210 defines sensing areas 212 (within key/target sensing area 212A) as a binary coded lock pattern corresponding to the binary coded key pattern of metallic/nonmetallic areas 215A/B of key/target 215. Sense coils 211 associated with metallic areas of the binary coded key pattern are referred to as active coils, and sense coils 211 associated with nonmetallic areas of the binary coded key pattern are referred to as inactive coils.

Sensor electronics 213 is configured to drive inductor coils 211, and to measure sensor response. Sensor electronics 213 includes sensor readout circuitry that acquires sensor response measurements (such as inductor coil inductance) representative of target proximity and, according to this Disclosure, target construction. For example, the inductive lock apparatus 210 including sensor electronics 213 can be configured for resonant inductive sensing, including sensor resonators (such as an LC tank circuits), and sensor electronics designed to drive sensor resonators, and acquire sensor response measurements from the sensor resonators.

As illustrated in FIG. 2, the binary coded sequence or lock/key pattern is 0101, and sensor electronics 213 is configured to switch/activate only for that code, detected as an unlock condition. That is, as illustrated in FIG. 2, inductive sensor lock apparatus 210 will switch/activate to detect an unlock condition only if key/target 215 is configured with a binary coded metal key pattern such that, when inserted proximate to inductive lock mechanism 210 (within key/target sensing area 212A), key/target metal is present within the sensing areas of only inductor/coils 2 and 4 (i.e., the active coils). Any other key pattern (code) will not trigger/activate the lock mechanism (i.e., sensor electronics 213 will not detect an unlock condition).

The example of lock apparatus 210 illustrated in FIG. 2 requires four sensor/readout circuits, or a single sensor readout circuit with a multiplexing scheme. If multiple sensor/readout circuits are used, the number increases with the number of bits used for the encoding.

Figure 3:
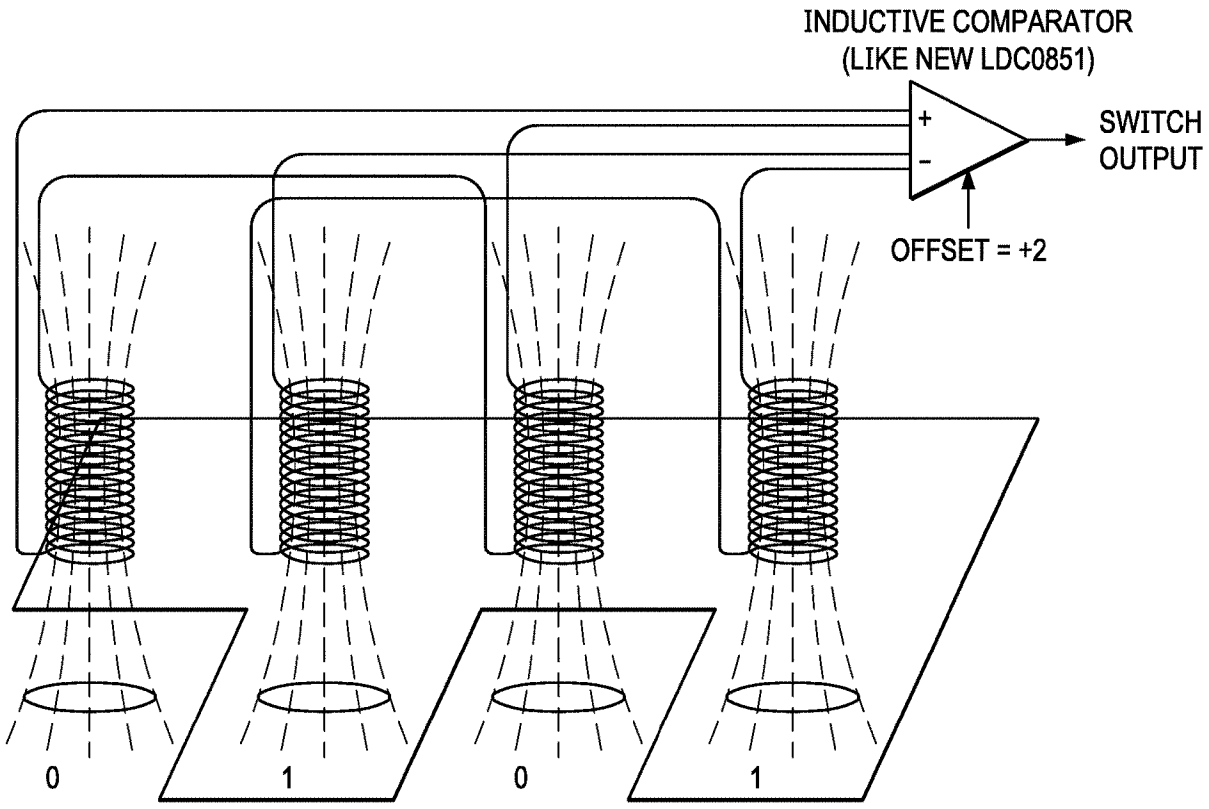
FIG. 3 illustrates an example of an inductive binary coded lock/security system (300), including an inductive lock apparatus (310), in which the sensor electronics is implemented with a differential inductance comparator (313) with L+ and L− differential inputs coupled to the inductor coils, and with an inductance offset (Loffset).
Figure 4A:
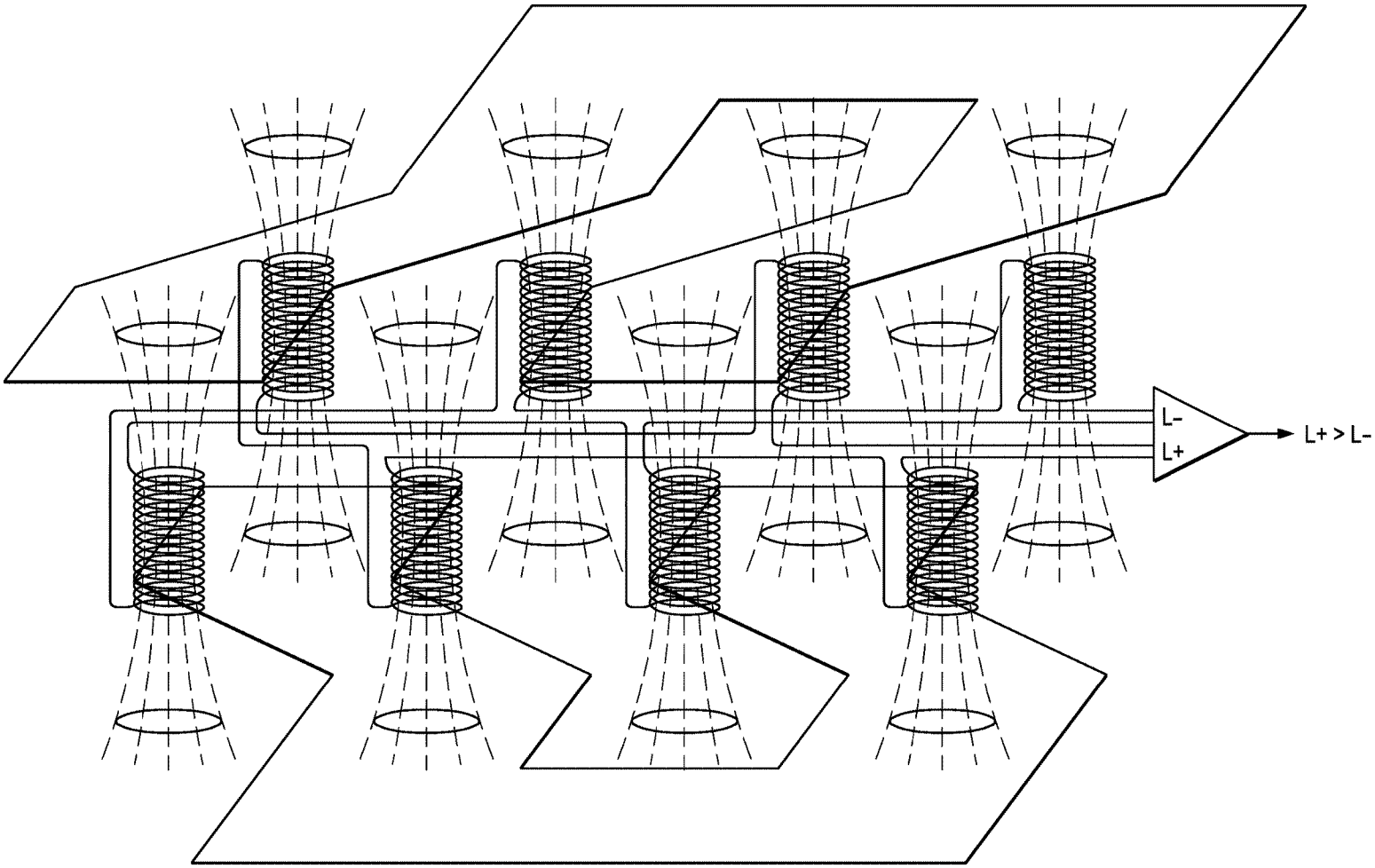
FIGS. 4A/4B illustrates an example of an inductive binary coded lock/security system (400), including an inductive lock apparatus (410) using a differential inductance comparator (413) with L+ and L− differential inputs, and including an internal sensor lock/target (414) that defines a binary coded sensor lock pattern.

FIGS. 3 and 4A/4B illustrate examples of inductive lock/security systems 300 and 400 including inductive lock apparatus 310 and 410, including inductor coils series connected to sensor electronics based on a differential inductance comparator 313 and 413.

FIG. 3 illustrates an example of an inductive lock apparatus 310, in which sensor electronics comprises a differential inductance comparator 313. Inductance comparator 313 is configured for operation with an inductance offset (Loffset).

Sense coils 311 are series connected to the L+ and L− inputs to inductance comparator 313 according to the binary coded lock/key pattern. Specifically, the active coils (illustrated as inductor coils 2 and 4 associated with active areas 315A of key/target 315) are series connected to L+, and the inactive coils (illustrated as inductor coils 1 and 3) are series connected to L−). Loffset corresponds to the difference in inductance due to the number of active coils connected to the L+ input of the comparator (minus one), and the number of inactive coils connected to the L− input, so that (L+)+(Loffset)>L−.

To trip inductance comparator 313, when the key/target 315 is inserted within the key/target sensing area 312A, the binary coded target key pattern 315A/B must match the binary-coded sensor lock pattern 312, as reflected in Loffset. That is, inductance comparator 313 measures the difference between two inductances, and activates (trips) if one is higher than the other (counteracting Loffset).

FIGS. 4A/4B illustrates an example inductive lock apparatus 410 using a differential inductance comparator 413 (with L+ and L− inputs), and including an internal sensor lock/target 418. As elaborated below, the internal sensor lock/target 418 defines a binary coded sensor lock pattern. This example takes advantage of the fact that both sides of an inductor coil have equal sensitivity (and can project oppositely-directed sensor magnetic fields into opposite sensing areas 412 and 416, i.e., within key/target sensing area 412A and sensor lock/target sensing area 416A).

Figure 4B:
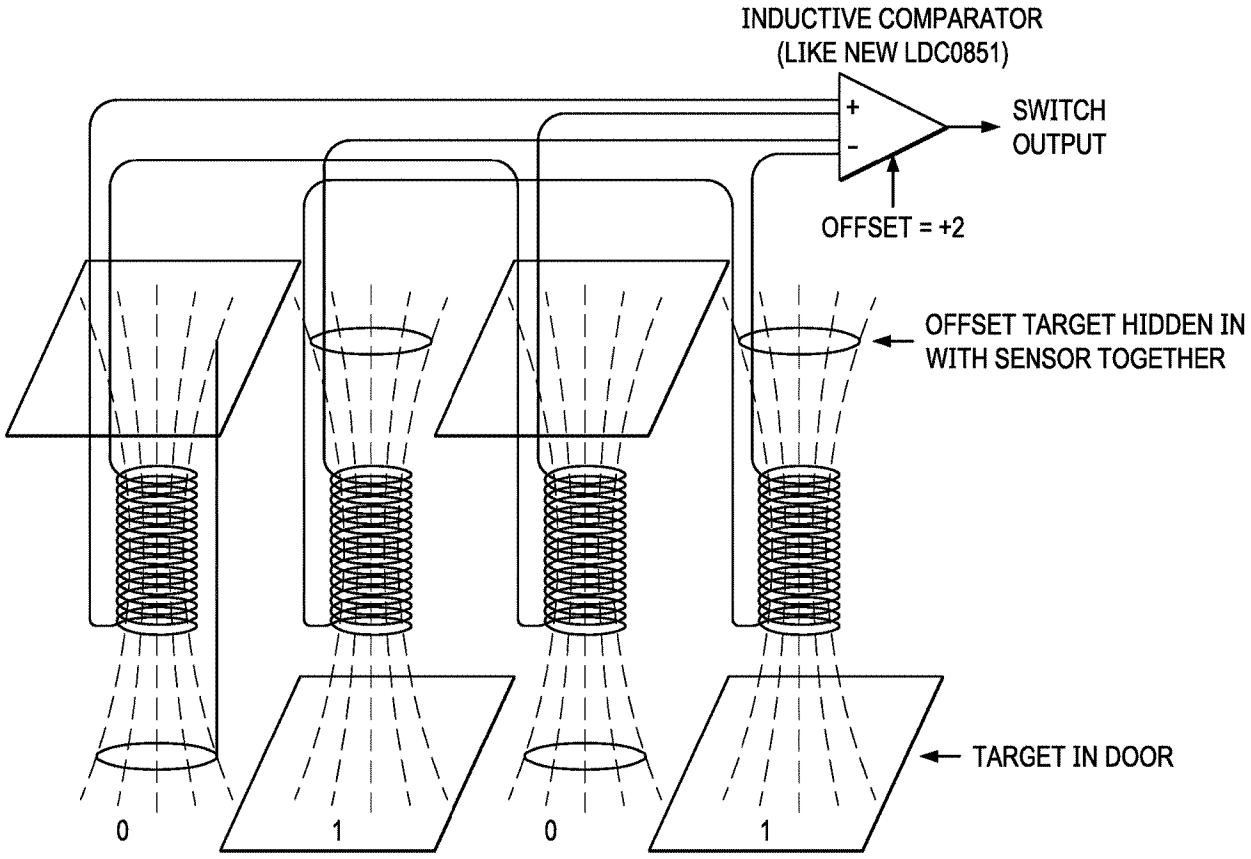
FIG. 4B illustrates a simplified version of the example inductive binary coded lock/security system of FIG. 4A.

FIG. 4A illustrates a functional embodiment with two rows of inductor coils, requiring correspondingly configured key/target 415 and sensor lock/target 414. FIG. 4B is a simplified version of the example inductive binary coded lock/security system of FIG. 4A.

For this embodiment, half of inductor coils 411_1-N are series connected to the L+ input, and the other half of inductor coils 411_1-N are connected to the L− input, without regard to whether a particular inductor coil is active or inactive (i.e., whether it will sense a metallic or nonmetallic area of key/target 415.

Sensor lock/target 418 defines a binary coded sensor lock pattern based on metallic/nonmetallic areas, effectively creating an inductance offset. The binary coded key pattern of key/target 415 is configured as complementary to the sensor lock pattern established by sensor lock/target 418 (in terms of active/inactive inductor coils). To trip (switch) inductance comparator 413, when the key/target 415 is inserted within key/target sensing area 412A, the active areas of the complementary key pattern of key/target 415 must be aligned with the inactive areas of the sensor lock pattern 418, counteracting the Loffset established by the sensor lock pattern of sensor lock/target 418.

Matching requirements for the distances between inductor coils 411 and sensor lock/target 418 and a proximate key/target 415 (inserted within key/target sensing area 412A) are not critical. However, to ensure trip/switching when key/target 415 is inserted proximate to lock apparatus 410 (inductor coils 411), the lock apparatus can be configured so that the proximate key/target 415 (when inserted into the key/target sensing area 412A) is closer to the inductor coils 411 than the internal sensor lock/target. For example, assume that the largest inductance change for one of the inactive inductor coils due to the presence a metallic area of target/lock 415 is delta_L, and that the difference in distance from inductor coils 411 to sensor lock/target 418 and to key/target 415 is delta_D. Ideally the sensor lock/target 418 and the key/target 415 cause identical inductance changes in the two chains of series connected inductor coils (identical distances to the inductor coils). However, to ensure trip/switching, key/target 415 can be placed closer to inductor coils 411 so long as the total inductance reduction in the chain due to delta_D is less than delta_L.

Advantages of this embodiment of the inductive lock mechanism include: (a) extension to an arbitrary number of bits, without requiring more inductance comparators, and (b) an equal number of identical inductor coils connected to the L+ and L− inputs of the inductance comparator.

For all embodiments, rather than having the binary 1 and 0 represented by a metal and nonmetal, the binary 1 and 0 can be represented by target metal at different distances relative to the inductor coils. For example, a zero can be represented by a conductive target at a larger distance, so that a 1 is represented, for example, by a bump on the key/target.

Advantages of the inductive binary coded inductive locking apparatus include allowing for many different keys, such that each lock can be given a unique key, and providing a security/sensor that cannot be defeated by the introduction of an external magnet (such as in reed switch security implementations. Also, the inductive binary coded sensor/switch is adaptable to configurations with a single differential inductance comparator, reducing system cost.

The Disclosure provided by this Description and the Figures sets forth example embodiments and applications illustrating aspects and features of the invention, and does not limit the scope of the invention, which is defined by the claims. Known circuits, functions and operations are not described in detail to avoid obscuring the principles and features of the invention. These example embodiments and applications can be used by ordinarily skilled artisans as a basis for modifications, substitutions and alternatives to construct other embodiments, including adaptations for other applications.

The invention claimed is:

1. An inductive coded lock system, comprising an inductive lock apparatus including multiple inductor coils each operable to project a magnetic sensing field to define a key/target sensing area proximate to the inductor coil, the inductor coils spatially arranged in a non-overlapping sequence to define a key-insertion sensing area incorporating each key/target sensing area; and an inductive key/target element dimensioned for insertion into the key-insertion sensing area, and including active and inactive key/target sections arranged in a pre-defined coded key-unlock sequence such that, when the key/target element is inserted into the key-insertion sensing area, each key/target section is aligned within a respective key/target sensing area; and the inductive lock apparatus including sensor circuitry to drive each of the inductor coils to project the magnetic field for the associated key/target sensing area, and to measure sensor response to a key/target element inserted within the key-insertion sensing area, including detecting an unlock condition corresponding to the pre-defined coded key-unlock sequence of active and inactive key/target sections.

2. The system of claim 1, wherein the pre-defined coded key-unlock sequence is binary coded.

3. The system of claim 1, wherein:

the sensor circuitry comprises a differential inductance comparator with L+ and L− inputs, and an Loffset input, and the inductor coils associated with active key/target sections of the key/target element are designated active inductor coils, and the inductor coils associated with the inactive key/target sections of the key/target element are designated inactive inductor coils, and the active inductor coils are series connected to the L+ input, and the inactive inductor coils are series connected to the L− input, such that the unlock condition corresponds to a differential sensor response input at the L+ and L− inputs that counteracts an offset value at the Loffset input.

4. The system of claim 1, wherein, the inductor coils are each operable to project a magnetic field to define a lock/target sensing area, proximate to the inductor coil, and opposite the respective projected key/target sensing area;

the inductive lock apparatus further includes a lock/target element disposed proximate to the inductor coils, within a lock-internal sensing area that includes each of the lock/target sensing areas, the lock/target element including active and inactive lock/target sections, each disposed within a respective lock/target sensing area;

the active and inactive lock/target sections arranged in a pre-defined coded internal-unlock sequence that is a complement to the pre-defined coded key-unlock sequence;

the sensor circuitry comprising a differential inductance comparator with L+ and L− inputs, with the L+ input series-connected to a first set of inductor coils;

the L− input series-connected to a second set of inductor coils.

5. The system of claim 1, wherein the active and inactive key/target sections of the key/target element are determined by one of: (a) conductive/active and nonconductive/inactive material, and (b) a distance of conductive material from an inductor coil.

6. The system of claim 4, wherein the distance between the inductor coils and the lock-internal sensing area is greater than the distance between the inductor coils and the key-insertion sensing area.

7. An inductive lock apparatus, for use in a system with a key/target element including active and inactive key/target sections arranged in a pre-defined coded key-unlock sequence, comprising multiple inductor coils each operable to project a magnetic field to define a key/target sensing area proximate to the inductor coil, the inductor coils spatially arranged in a non-overlapping sequence to define a key-insertion sensing area encompassing each key/target sensing area;

the inductive lock apparatus adapted for insertion of the key/target element within the key-insertion sensing area, such that each key/target section aligns with a respective key/target sensing area; and sensor circuitry to drive each of the inductor coils to project a magnetic field into the associated key/target sensing area, and to measure sensor response to a key/target element inserted within the key-insertion sensing area, including detecting an unlock condition corresponding to the pre-defined coded key-unlock sequence of active and inactive target sections.

8. The apparatus of claim 7, wherein the coded unlock sequence is binary coded.

9. The apparatus of claim 7, wherein:

the sensor circuitry comprises a differential inductance comparator with L+ and L− inputs, and an Loffset input, and the inductor coils associated with active key/target sections of the key/target element are designated active inductor coils, and the inductor coils associated with the inactive key/target sections of the key/target element are designated inactive inductor coils; and the active inductor coils series connected to the L+ input, and the inactive inductor coils series connected to the L− input, such that the unlock condition corresponds to a differential sensor response input at the L+ and L− inputs that counteracts an offset value at the Loffset input.

10. The apparatus of claim 7, wherein the inductor coils each operable to project a magnetic field to define a lock/target sensing area proximate to the inductor coil, and opposite the respective projected key/target sensing area;

the inductive lock apparatus further includes a lock/target element disposed proximate to the inductor coils, within a lock-internal sensing area that includes each of the lock/target sensing areas, the lock/target element including active and inactive lock/target sections, each disposed within a respective lock/target sensing area;

the active and inactive lock/target sections arranged in a pre-defined coded internal-unlock sequence that is a complement to the pre-defined coded key-unlock sequence;

the sensor circuitry comprising a differential inductance comparator with L+ and L− inputs, with the L+ input series-connected to a first set of inductor coils;

the L− input series-connected to a second set of inductor coils.

11. The apparatus of claim 7, wherein the active and inactive key/target sections of the key/target element are determined by one of: (a) conductive/active and nonconductive/inactive material, and (b) a distance of conductive material from an inductor coil.

12. The apparatus of claim 10, wherein the distance between the inductor coils and the lock-internal sensing area is greater than the distance between the inductor coils and the key-insertion sensing area.

13. A key/target element for use in a system with an inductive lock apparatus that includes multiple inductor coils each operable to project a magnetic field to define a key/target sensing area proximate to the inductor coil, the inductor coils spatially arranged in a non-overlapping sequence to define a key-insertion sensing area encompassing each key/target sensing area, the inductive lock apparatus including sensor circuitry to drive each of the inductor coils to project a magnetic sensing field into the associated key/target sensing area, and to measure sensor response to a key/target element inserted within the key-insertion sensing area, the key/target element comprising:

active and inactive key/target sections arranged in a pre-defined coded key-unlock sequence; and the key/target element adapted for insertion within the key-insertion sensing area of the inductive lock apparatus, such that each key/target section aligns with a respective key/target sensing area; and such that, when the key/target element is inserted into the key-insertion sensing area of the inductive lock apparatus, the pre-defined coded key-unlock sequence is detectable by the inductive lock apparatus as a an unlock condition.

14. The key/target element of claim 13, wherein the coded unlock sequence is binary coded.

15. The key/target element of claim 13, wherein:

the sensor circuitry of the inductive lock apparatus includes a differential inductance comparator with L+ and L− inputs, and an Loffset input, and the inductor coils associated with active key/target sections of the key/target element are designated active inductor coils, and the inductor coils associated with the inactive key/target sections of the key/target element are designated inactive inductor coils; and the active inductor coils series connected to the L+ input, and the inactive inductor coils series connected to the L− input, such that the unlock condition corresponds to a differential sensor response input at the L+ and L− inputs that counteracts an offset value at the Loffset input.

16. The key/target element of claim 13, wherein the inductor coils are each operable to project a magnetic field to define a lock/target sensing area proximate to the inductor coil, and opposite the respective projected key/target sensing area;

the inductive lock apparatus further includes a lock/target element disposed proximate to the inductor coils, within a lock-internal sensing area that includes each of the lock/target sensing areas, the lock/target element including active and inactive lock/target sections, each disposed within a respective lock/target sensing area;

the active and inactive lock/target sections arranged in a pre-defined coded internal-unlock sequence that is a complement to the pre-defined coded key-unlock sequence;

the sensor circuitry comprising a differential inductance comparator with L+ and L− inputs, with the L+ input series-connected to a first set of inductor coils;

the L− input series-connected to a second set of inductor coils.

17. The key/target element of claim 13, wherein the active and inactive key/target sections of the key/target element are determined by one of: (a) conductive/active and nonconductive/inactive material, and (b) a distance of conductive material from an inductor coil.

18. The key/target element of claim 16, wherein the distance between the inductor coils and the lock-internal sensing area is greater than the distance between the inductor coils and the key-insertion sensing area.

* * * * *